United States Patent [19]

Kamimura

[11] 4,269,111

[45] May 26, 1981

[54] HYDRAULIC APPARATUS

[75] Inventor: Toshio Kamimura, Gifu, Japan

[73] Assignee: Teijin Seiki Company Limited, Osaka, Japan

[21] Appl. No.: 71,026

[22] Filed: Aug. 29, 1979

[30] Foreign Application Priority Data

Sep. 7, 1978 [JP] Japan ..... 53-110027

[51] Int. Cl.[3] ..... F15B 13/042; F15B 13/16

[52] U.S. Cl. ..... 91/419; 91/447; 91/400

[58] Field of Search ..... 91/447, 419, 400

[56] References Cited

U.S. PATENT DOCUMENTS

| | | | |
|---|---|---|---|
| 2,410,978 | 11/1946 | Kelly | 91/419 |
| 3,205,788 | 9/1965 | Limbrick | 91/419 |
| 3,381,587 | 5/1968 | Porquet | 91/447 |
| 3,750,532 | 8/1973 | Kubilos | 91/445 |

FOREIGN PATENT DOCUMENTS

| | | | |
|---|---|---|---|
| 1149871 | 7/1957 | France | 91/447 |
| 603795 | 6/1948 | United Kingdom | 91/447 |

*Primary Examiner*—Paul E. Maslousky

*Attorney, Agent, or Firm*—Cushman, Darby & Cushman

[57] ABSTRACT

The hydraulic apparatus includes a valve which is closable to prevent fluid from flowing out of a cylinder chamber when the pressure of the fluid drops below a predetermined level, and a transmitter which opens the valve so as to keep the chamber pressure constant when a piston slidably received in the chamber moves due to heat-caused expansion of the fluid in the chamber. The apparatus is disclosed in the context of an aircraft spoiler control system.

3 Claims, 4 Drawing Figures

HYDRAULIC APPARATUS

The present invention relates to a hydraulic apparatus, and in particular to an apparatus which is adapted to slightly discharge fluid under pressure outwardly of a hydraulic cylinder and to prevent breakage of the hydraulic cylinder when a hydraulic pump is broken and can not feed the fluid under pressure into the hydraulic cylinder, thereby causing the piston in the hydraulic cylinder to be fluidally locked and then causing the fluid under pressure hermetically sealed in the hydraulic cylinder to be raised in temperature and to be heat expanded.

In general, a spoiler of an air craft is boosted upwardly as shown in FIG. 1 by a lift which is generated by difference in pressure between upper and lower surfaces of a wing during flight of the air craft. The spoiler 1 is at all times held horizontally by a hydraulic cylinder for controlling the spoiler 1. If the fluid under pressure is not fed into the hydraulic cylinder 2 by the reason of breakage of the hydraulic pump or otherwise and the pressure of the fluid under pressure is dropped below a predetermined pressure level, the hydraulic cylinder 2 can not hold the spoiler 1 horizontally and the spoiler 1 is thus boosted upwardly to a position shown in phantom line where difference in pressure between the upper and lower surfaces of the spoiler 1 become zero. If the spoiler 1 is boosted upwardly to that position, the lift received by all the wings comes to be dropped and thus altitude of the air craft is also dropped, thereby finally falling on the earth.

Conventionally, there has been proposed such a hydraulic apparatus as shown in FIG. 2 in which a piston of the hydraulic cylinder 2 can be fluidally locked to a predetermined position when the fluid under pressure is not fed into the hydraulic cylinder 2 as previously described. More specifically, the conventional hydraulic apparatus comprises a fluid supply passage 3 in communication with a hydraulic pump to allow the fluid under pressure to pass therethrough, a fluid return passage 4 in communication with a reservoir tank to allow a returning fluid under pressure to pass therethrough, a hydraulic cylinder 2 having two cylinder chambers 6 and 7 partitioned by a piston 5 having a piston rod 8 the forward end of which is connected with the spoiler 1, a first inlet-outlet passage 10 having one end connected with the cylinder chamber 6, a second inlet-outlet passage 11 having one end connected with the cylinder chamber 7, a change-over valve 12 connected with the fluid supply passage 3, the fluid return passage 4, the first and second inlet-outlet passages 10 and 11 to change flow direction of the fluid under pressure passing therethrough, a hold-down valve 13 provided on the first inlet-outlet passage 10 to be closed when pressure of the fluid under pressure in the fluid supply passage 3 is dropped below a predetermined pressure level, and a connecting passage 15 connecting the first inlet-outlet passage 10 with the fluid return passage 4 and having a thermal relief valve 14. When pressure of the fluid under pressure in the fluid supply passage 3 is dropped below a predetermined pressure level due to for example breakage of the hydraulic pump or the like in the above conventional hydraulic apparatus, the hold-down valve 13 is closed to fluidally lock the piston 5 in the cylinder 2 and thereby to regulate the movement of the spoiler 1, while when the fluid under pressure in the cylinder chamber 6 is heat-expanded by the reason of temperature change caused by abrupt changing to low altitude flight from high altitude flight only the amount of the fluid under pressure heat-expanded and increased is adapted to be returned to the reservoir tank by the action of the thermal relief valve 14. However, such a thermal relief valve 14, which is shown in FIG. 2 as comprising a valve seat 16, a poppet 17 to close the valve seat 16 upon engagement with the valve seat 16, and a compression coil spring 18 biasing at all times the poppet 17 into engagement with the valve seat 16, has various drawbacks as follows. Firstly, it is impossible to completely engage a seat face of the poppet 17 with a seat face of the valve seat 16 without leakage of the fluid under pressure even if the seat faces are high-accurately machined so that such leakage occurs even at a pressure level relatively low as compared with a predetermined pressure level. Secondly, the seat faces of the valve seat 16 and the poppet 17 are at all times in fluid flow and thus liable to erosion as time lapses, resulting a large quantity of leakage therebetween. One of the causes of the erosion is a continuous leakage caused by incomplete engagement of the seat faces of the valve seat 16 and the poppet 17.The other of the causes of the erosion is such that the fluid under pressure is passed between the valve seat 16 and the poppet 17 little by little for a long period of time at a high speed around the predetermined pressure level of the thermal relief valve 14 ranging from a relief beginning pressure to a relief complete opening pressure. As a consequence of the erosion, the fluid under pressure in the cylinder chamber 6 was leaked outwardly from the thermal relief valve 14 even at a low pressure level, which makes it impossible to fluidally lock the piston 5 at its normal position. Thirdly, a high pressure fluid force at all times acts upon the poppet 17 of the thermal relief valve 14 and urges the poppet 17 to be opened against the compression coil spring 18 with a predetermined high pressure at an abnormal time when the hydraulic pump is broken to heat-expanded a sealed fluid in the cylinder chamber 6 as well as at a normal time when the piston 5 is operated to be fluidally locked. As a consequence, such an erosion occurs on the thermal relief valve 14 for a long period of time, which is apt to reduce safety and flight time for the air craft. For overcoming the previously mentioned drawbacks, the seat faces of the poppet 17 and the valve seat 16 were more accurately machined and such a poppet 17 as having sapphire and a ruby was tried to be used for preventing such erosion. However, the above leakage could not be completely prevented and the hydraulic apparatus was exorbitantly expensive.

It is therefore an object of the present invention to provide a hydraulic apparatus which overcomes the previously mentioned drawbacks and can completely prevent leakage of the fluid under pressure as well as can be produced inexpensively.

It is another object of the present invention to provide a hydaulic apparatus which can remove such a thermal relief valve as positioned to be opened by the high pressure force against the compression coil spring 18 with a predetermined high pressure at a normal state of the hydraulic pump.

In order to accomplish the foregoing object there is provided a hydraulic apparatus according to the present invention which comprises a pair of fluid passages provided thereon with a hydraulic pump, a reservoir tank and a change-over valve; a hydraulic cylinder having first and second cylinder chambers which are partitioned by a piston accommodated in the hydraulic cylinder; a first inlet-outlet passage having one end connected with the change-over valve and the other end connected with the first cylinder chamber; a second inlet-outlet passage having one end connected with the change-over valve and the other end connected with the second cylinder chamber; a valve means provided on the first inlet-outlet passage and closable as fluid under pressure passing through the first inlet-outlet passage from the hydraulic pump comes to be dropped below a predetermined pressure, the valve means including a check valve permitting fluid under pressure to be introduced into the first cylinder chamber from the change-over valve, a biasing plunger disposed in opposing relation with the check valve and movable toward and away from the check valve, a compression coil spring resiliently urging the biasing plunger away from the check valve, and a pilot passage having one end connected with the fluid passage between the hydraulic pump and the change-over valve and the other end connected with the biasing plunger to enable fluid under pressure to be introduced into the biasing plunger from the hydraulic pump so that the biasing plunger is moved toward the check valve to bias and open the check valve; and a transmitting means transmitting a force generated by heat expansion of fluid under pressure in the first cylinder chamber to the biasing plunger so as to enable the biasing plunger to be moved toward the check valve against the compression coil spring so that the check valve is opened to cause fluid under pressure in the first cylinder chamber to be dischanged therefrom.

The above and other objects, features and advantages of the present invention will become clear from the following particular description of the invention and the appended claims, taken in conjunction with the accompanying drawings which show by way of example a preferred embodiment of the present invention.

Figure 1:
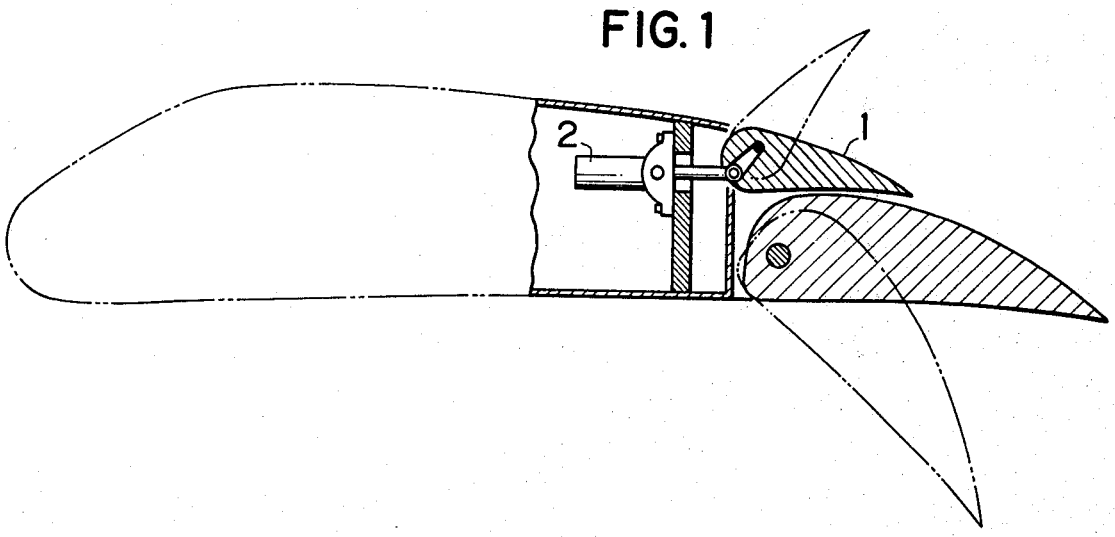
FIG. 1 is a partially cross-sectioned view of a wing of an air craft particularly showing a spoiler and its environmental elements.
Figure 2:
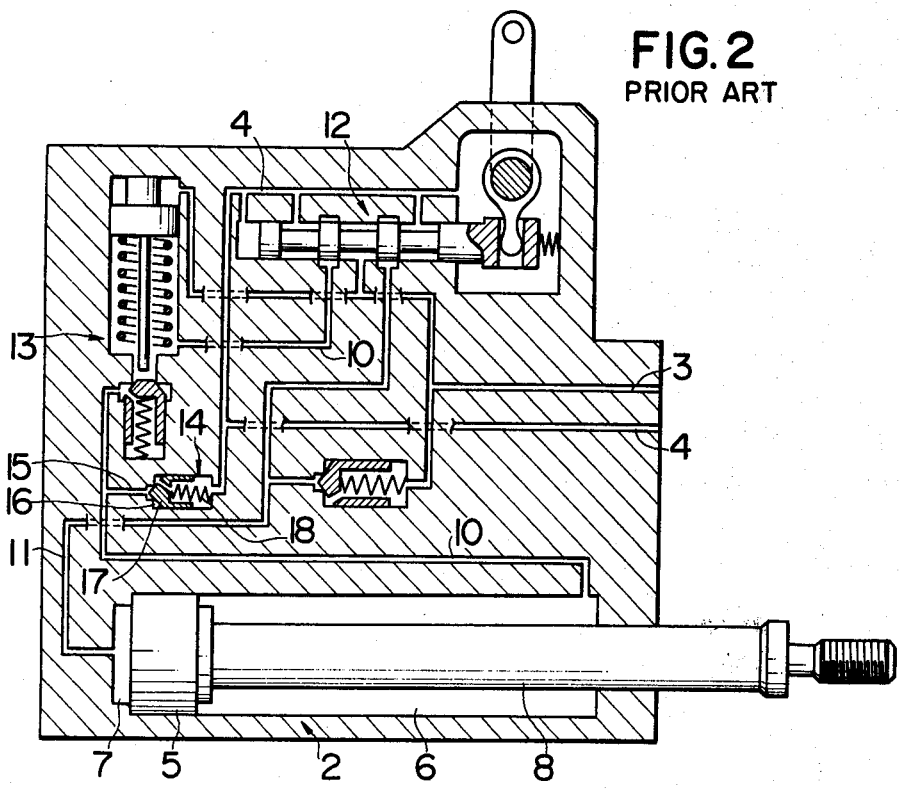
FIG. 2 PRIOR ART
FIG.2 is a cross-sectional view of a conventional hydraulic apparatus.
Figure 3:
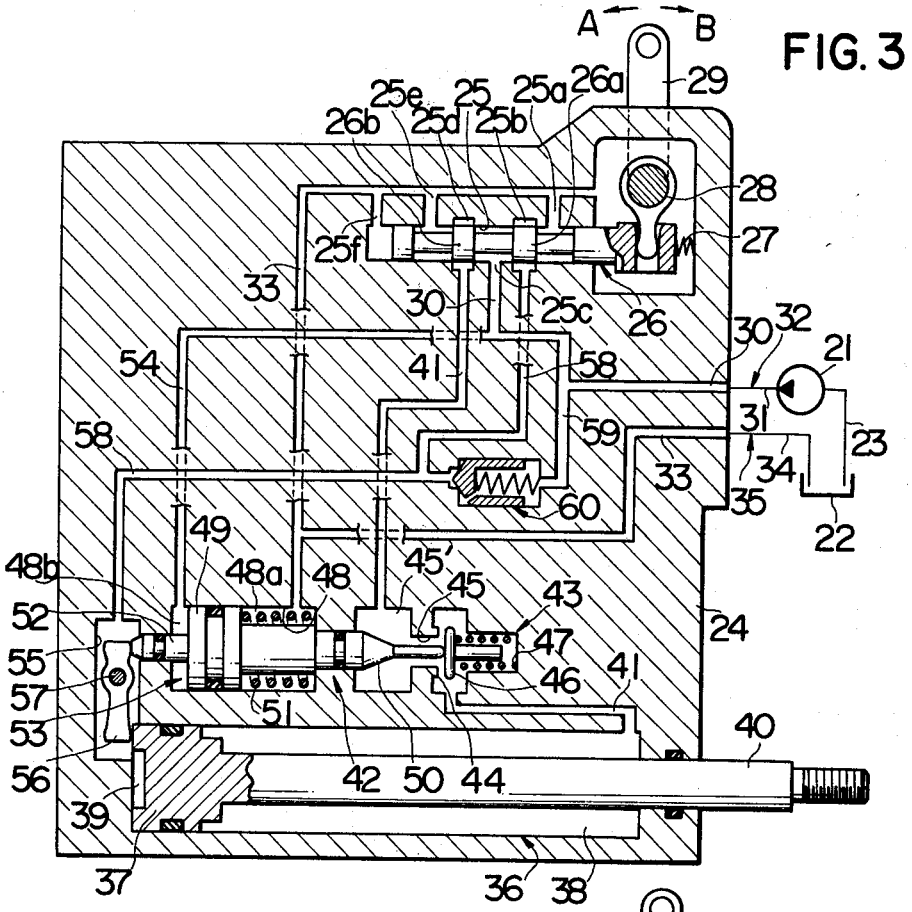
FIG. 3 is a cross-sectional view of a hydraulic apparatus embodying the present invention.

Referring now to the drawings, and in particular to FIG. 3, the reference numeral 21 indicates a hydraulic pump from which a pressurized oil is discharged. A reservoir tank 22 which reserves the oil is connected with the hydraulic pump 21 through a first passage 23. A housing 24 has therein a valve chamber 25 in which a change-over valve 26 is slidably received to be leftwardly urged at all times by a compression coil spring 27. On the inner peripheral wall of the valve chamber 25 from its one end to the other end are formed or opened first, second, third, fourth, fifth and sixth ports 25*a*, 25*b*, 25*c*, 25*d*, 25*e*, and 25*f*, the second and fourth ports 25*b* and 25*d* being respectively closed by first and second lands 26*a* and 26*b* of a change-over valve 26 when the change-over valve 26 is positioned at its null position. A rockable lever 29, which has a longitudinally intermediate portion pivotally connected by a pivotal pin 28 with the housing 24, is connected at one end with one end of the change-over valve 26 and projected outwardly of the housing 24. With the lever 29 rocked in the direction of an arrow A, the change-over valve 26 is moved to permit the second and third ports 25*b* and 25*c* to be brought into communication with each other. On the contrary, the change-over valve 26 is moved with the lever 29 rocked in the direction of an arrow B, to permit the third and fourth ports 25*c* and 25*d* to be brought into communication with each other. The leftward urging of the change-over valve 26 by the compression spring 27 is due to eliminating undesirable effect caused by an allowance between the change-over valve 26 and the rockable lever 29. Within the housing 24 is formed a second passage 30 which has one end in communication with the third port 25*c* and the other end opened at the outer face of the housing 24. A third passage 31 is communicated at one end with the other end of the second passage 30 and at the other end with the hydrualic pump 21 so as to enable fluid under pressure to be discharged from the hydraulic pump 21 to the third port 25*c* through the third and second passages 31 and 30. The previously mentioned second and third passages 30 and 31 constitutes as a whole a fluid supply passage generally indicated at 32. Within the housing 24 is formed a fourth passage 33 which has three branched one end portions in communication with the first, fifth and sixth ports 25*a*, 25*e* and 25*f* and the other end portion opened at the other face of the housing 24. At the longitudinally intermediate portion of the fourth passage 33 is formed a plunger chamber which will be apparent as the description proceeds hereinlater. A fifth passage 34 is provided to have one end in communication with the other end portion of the fourth passage 33 and the other end connected with the reservoir tank 22. The previously mentioned fourth and fifth passages 33 and 34 constitutes as a whole a fluid return passage generally denoted at 35. Within a hydraulic cylinder 36 formed in the housing 24 is slidably received a piston 37 which partitions the hydraulic cylinder 36 into two cylinder chambers 38 and 39, i.e., first and second chambers 38 and 39. Integrally formed with the piston 37 is a piston rod 40 which is adapted to be projected outwardly from the housing 24 and connected at its forward end with a spoiler of a suitable air craft through a link mechanism which is not shown in the drawings. When the piston rod 40 is projected the spoiler is boosted toward the vertical line with respect to a wing of the air craft, and when the piston rod 40 is retracted the spoiler is held down toward the horizontal line with respect to the wing. A first inlet-outlet passage 41 is formed in the housing 24 to be connected at one end with the fourth port 25*d* of the valve chamber 25 and at the other end with the first cylinder chamber 38. On the first inlet-outlet passage 41 is provided a valve means generally represented by the reference numeral 42 which has a poppet type check valve also generally represented by the reference numeral 43 permitting fluid under pressure to be introduced into the first cylinder chamber 38 from the fourth port 25*d* of the valve chamber 25. The check valve 43 comprises a valve seat 44 formed flatly, a poppet 46 having a seat portion formed flatly to be engageable with the valve seat 44 and enabling a valve seat bore 45, formed in the valve seat 44, to be closed when the poppet 46 is brought into engagement with the valve seat 44, and a compression coil spring 47 resiliently urging at all times the poppet 46 to be brought into engagement with the valve seat 44. A chamber 45' is formed in the housing 24 in communication with the valve seat bore 45. The chamber 45' and the valve seat bore 45 partly constitute the first inlet-outlet passage 41 in the present invention. In the housing 24 is also formed a plunger chamber 48 in which a plunger body 49 is accommodated to be movable toward and away from the poppet 46 of the check valve 43 and to partition the plunger chamber 48 into first and second plunger chamber sections 48*a* and 48*b*. The first plunger chamber 48*a* is in communication with the fourth passage 33, while the second plunger chamber 48*b* is in communication with a pilot passage as will be understood hereinafter. A rod 50 which is positioned in opposing relation with the poppet 46 and in coaxial relation with the plunger body 49 is adapted to project from the plunger chamber section 48*a* to the chamber 45' and to have its forward end positioned within the valve seat bore 45. A compression coil spring 51 has one end in engagement with end face of the first plunger chamber 48*a* and the other end in engagement with the plunger body 49 so as to urge the plunger body 49 at all times away from the poppet 46 of the check valve 43. On the other end face of the plunger body 49 is formed a rod or an axial end extension 52 which is in coaxial relation with the plunger body 49 to have the other end portion 52 extending outwardly from the other end of the second plunger chamber section 48*b*. The previously mentioned plunger body 49, and the rods 50 and 52 constitute as a whole a biasing plunger generally indicated by the reference numeral 53 which enables the check valve 43 to be biased and opened when the biasing plunger 53 is moved toward the check valve 43. The reference numeral 54 designates a pilot passage which is formed in the housing 24 to have one end connected with the intermediate portion of the second passage 30 and the other end connected with the plunger chamber section 48*b* so that fluid under pressure can be introduced into the second plunger chamber section 48*b* from the hydraulic pump 21 to cause the biasing plunger 53 to be moved into engagement with the poppet 46 of the check valve 43 against the compression coil spring 51. Formed at the other end side of the plunger chamber 48 within the housing 24 in communication with the second cylinder chamber 39 is an arm chamber 55 into which the other end portion of the rod 52 is projected. In the arm chamber 55 is provided a rockable arm 56 which has a longitudinally intermediate portion rockably connected with the housing 24 through a pivotal pin 57. One end portion of the rockable arm 56 is adapted to extend into the second cylinder chamber 39 so that the one end portion of the rockable arm 56 can be engaged with the piston 37 when the piston 37 is moved to the other end of the hydraulic cylinder 36. It is therefore to be noted that the other end portion of the rockable arm 56 is in engagement with the other end of the rod 52 under the state that high fluid under pressure is not introduced into the second plunger chamber section 48*b*. If the piston 37 is brought into engagement with the rockable arm 56 under these condition, the rockable arm 56 is rocked to move the biasing plunger 53 toward the poppet 46 of the check valve 43 against the compression coil spring 51. A second inlet-outlet passage 58 is formed in the housing 24 to have one end connected with the second port 25*b* of the valve chamber 25 and the other end connected with the second cylinder chamber 39 through the arm chamber 55. The reference numeral 59 denotes a sixth passage which is formed in the housing 24 to have one end connected with the intermediate portion of the second passage 30 and the other end connected with the intermediate portion of the second inlet-outlet passage 58. On the intermediate portion of the sixth passage 59 is formed a blow-down relief valve 60 which allows only fluid under pressure to pass from the second inlet-outlet passage 58 to the second passage 30. The rockable lever 29 and the spoiler of the air craft are connected by means of a suitable feed-back mechanism which is well known in the art and thus not shown nor described so that when the output of the spoiler, i.e., the rocked angle of the spoiler corresponding to the input imparted to the rockable lever 29, i.e., the rocked angle of the rockable lever 29 is obtained, the first and second lands 26*a* and 26*b* of the change-over valve 26 close the second and fourth ports 25*b* and 25*d* to effect a servo control.

The operation of the hydraulic apparatus thus constructed will now be described hereinlater.

During flight of the air craft the piston rod 40 is retracted to move the spoiler horizontally with respect to the wing. At this time, the change-over valve 26 is maintained under its neutral state as shown in FIG. 3 by means of a feed-back mechanism connecting the rockable lever 29 and the spoiler, so that high fluid under pressure at all times discharged from the hydraulic pump 21 is introduced into the second plunger chamber 48*b* through the fluid supply passage 32 and the pilot passage 54 to cause the biasing plunger 53 to be urged against the compression coil spring 51. As a result, the poppet 46 of the check valve 43 is opened against the compression coil spring 47 by the rod 50 of the biasing plunger 53 to maintain the check valve 43 as shown in FIG. 3, while the other end of the piston 37 is also maintained in engagement with the other end face of the hydraulic cylinder 36 as shown in FIG. 3. When an abrupt increase of lift acted upon the spoiler urges the piston rod 40 away from the rockable arm 56, the rockable lever 29 is urged to be rocked in the direction of an arrow B by the previously mentioned feed-back mechanism. When the rockable lever 29 is caused to be swung toward the direction of the arrow B, the change-over valve 26 is moved leftwardly in FIG. 3. The third port 25*c* is thus brought into communication with the fourth port 25*d* so that high fluid under pressure discharged from the hydraulic pump 21 is fed to the first inlet-outlet passage 41 through the fluid supply passage 32, the third port 25*c*, the valve chamber 25 and the fourth port 25*d*. The fluid under pressure in the first inlet-outlet passage 41 is then fed to the first cylinder chamber 38 to urge the piston 37 toward the rockable arm 56 until the piston 37 comes to be engaged with the other end face of the hydraulic cylinder 36. On the other hand, the fluid under pressure in the second cylinder chamber 39 is returned to the reservoir tank 22 through the arm chamber 56, the second inlet-outlet passage 58, the second port 25*b*, the valve chamber 25, the first port 25*a* and the fluid return passage 35. If the high fluid under pressure is being discharged from the hydraulic pump 21 as previously mentioned, the piston 37 is never moved away from the rockable arm 56 by the lift acted on the spoiler. When the high fluid under pressure from the hydraulic pump 21 is then dropped to a predetermined pressure level by a certain reason such as for example breakage of the hydraulic pump 21, the fluid under pressure in the second plunger chamber 48*b* is also dropped so that the biasing plunger 53 is moved away from the poppet 46 of the check valve 43 by the action of the compression coil spring 51. Consequently, the poppet 46 is urged by the compression coil spring 47 into engagement with the valve seat 44 to close the check valve 43, thereby closing the first inlet-outlet passage 41. When the check value 43 is changed from its opened states to its closed state, the piston 37 is moved slightly away from the rockable arm 56 by the lift acted on the spoiler. The movement amount of the piston 37 is calculated mainly from an inner diameter dimension of the hydraulic cylinder 36, an outer diameter dimension of the piston rod 40, an amount of the lift acted to move the piston 37 away from the rockable arm 56, an area of the check valve 43 allowing fluid under pressure to pass therethrough, time lapsing from the opened state of the check valve 43 to the closed state of the check valve 43, and the like. For the movement amount of the piston 37, dimensions of various constitutional elements are determined in view of flights of the air craft. Design for determining such dimensions is to such degree that those shilled in the art can readily design. When the check valve 43 is closed, fluid under pressure is introduced only into the first cylinder chamber 38 from the fourth port **25*d* through the check valve 43 and not discharged from the cylinder chamber 38. The piston 37 is therefore fluidally locked, and the piston rod 40 is never moved even if the spoiler is acted by the lift caused by difference in pressure between the upper and lower faces of the spoiler. As a result, the spoiler is maintained horizontally with respect to the wing even if the fluid under pressure fed from the hydraulic pump 21 is dropped below the predetermined pressure level. Although at this time, the rockable arm 56 is engaged at one end with the piston 37 and at the other end with the rod 52 of the biasing plunger 53, an extremely small gap is generated between the forward end face of the piston 37 and the end face of the second cylinder chamber 39 in opposing relation with the forward end face of the piston 37 since the piston 37 is slightly moved away from the rockable arm 56. When the environmental temperature is then raised by for example altitude circumstances, the fluid under pressure hermetically sealed in the first cylinder chamber 38 is heat expanded. The heat expanded fluid under pressure can not be discharged outwardly of the first cylinder chamber 38 through the first inlet-outlet passage 41 since the check valve 43 is closed, whereas the piston 37 is urged to be moved toward the rockable arm 56 since the previously mentioned small gap is generated between the forward end face of the piston 37 and the end face of the cylinder chamber section 39. As a consequence, the piston 37 is brought into engagement with one end of the rockable arm 56 to swing the rockable arm 56 around the pivotal pin 57. The swing of the rockable arm 56 causes the other end of the rockable arm 56 to be engaged with the rod 52 of the biasing plunger 53 so that the biasing plunger 53 is moved against the compression coil spring 51 toward the poppet 46 of the check valve 43. It is thus to be noted that the movement of the piston 37, i.e., the force generated by heat expansion of fluid under pressure in the first cylinder chamber 38 is transmitted through the rockable arm 56 to the biasing plunger 53. The movement of the biasing plunger 53 causes the poppet 46 to be opened against the compression coil spring 47 to maintain the check valve 43 opened. Consequently, the fluid under pressure hermetically sealed in the first cylinder chamber 38 is slightly discharged therefrom through the first inlet-outlet passage 41, the change-over valve 26 and the fluid return passage 35 so that the piston 37 is slightly moved away from the rockable arm 37 and the rockable arm 56 is swung counterclockwise in FIG. 3. The biasing plunger 53 is thus urged by the compression coil spring 51 to be moved away from the poppet 46, thereby closing the check valve 43** again.

For descending and turning the air craft, the piston rod 40 is projected to boost the spoiler perpendicularly with respect to the wing. In this case, the rockable lever 29 is swung in the direction of an arrow A. The second port **25*b* comes to be in communication with the third port 25*c* so that the high fluid under pressure discharged from the hydraulic pump 21 is introduced into the second cylinder chamber 39 through the fluid supply passage 32, the second inlet-outlet passage 58 and the arm chamber 55 to move the piston 37 away from the rockable arm 56. At this time, the high fluid under pressure is introduced into the second plunger chamber section 48*b* through the pilot passage 54, and the biasing plunger 53 thus causes the poppet 46 to be opened, maintaining the check valve 43 in its open state. On the other hand, the fluid under pressure in the first cylinder chamber 38 is returned to the reservoir tank 22 through the first inlet-outlet passage 41, the change-over valve 26 and the fluid return passage 35 as the check valve 43 is in its opened state. As a result of this, the piston rod 40** is projected.

Figure 4:
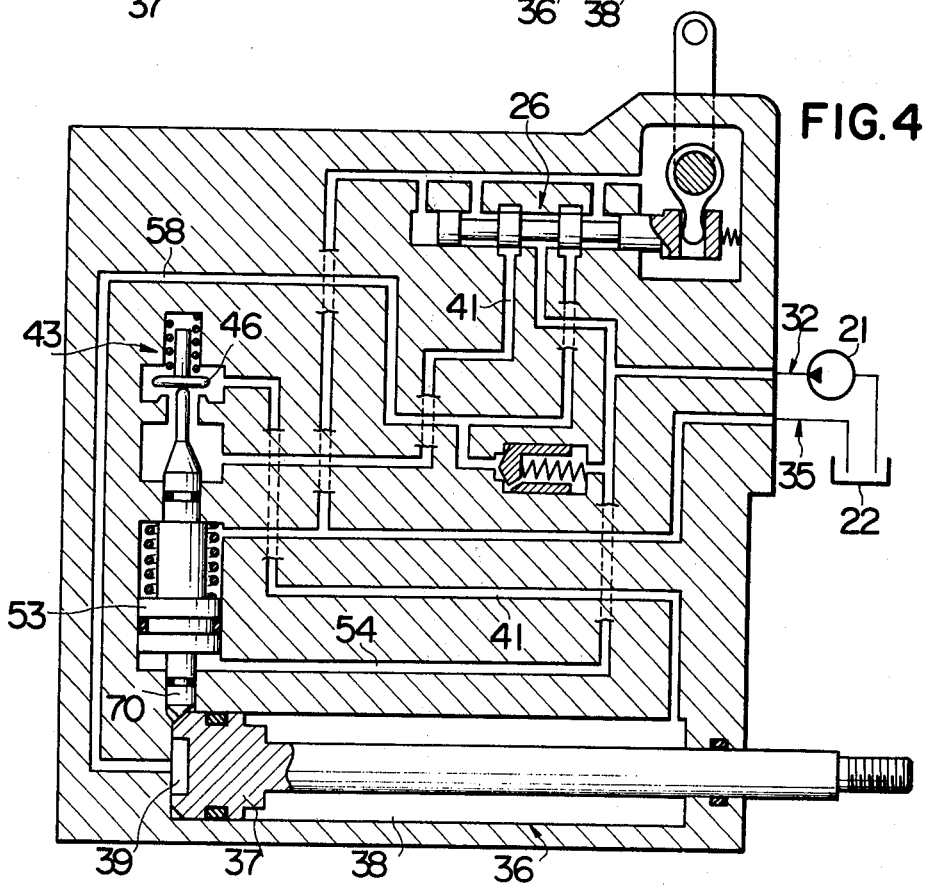
FIG. 4 is a cross-sectional view similar to FIG. 3 but showing another embodiment of the present invention.

According to the present invention, the biasing plunger 53 and the check valve 43 may be positioned to extend radially with respect to the axis of the piston 37 as will be seen in FIG. 4 wherein a transmitting rod 70 is required to be tapered at its radially inner end to be engaged with the piston 37 which is also required to be tapered at its peripheral face. With this construction, the piston 37 can be moved into engagement with the transmitting rod 70, whereupon the transmitting rod 70 is moved radially together with the biasing plunger 53 to open the check valve 43. The remaining construction of the apparatus shown in FIG. 4 is substantially the same as in FIG. 3.

While there have been previously described such embodiments that the piston 37 is moved with respect to the hydraulic cylinder 36, the hydraulic cylinder 36 equipped with loads may be moved with respect to the piston 37 according to the present invention. It is required therefore that the hydraulic cylinder 36 and the piston 37 are relatively moved with each other.

As has been described above, the hydraulic apparatus according to the present invention can eliminate such a thermal relief valve as necessitated in the conventional hydraulic apparatus as well as can be produced inexpensively, and does not require such a high accurate machining as in the conventional apparatus.

Although particular embodiments of the present invention have been shown and described, it will be obvious to those skilled in the art that various changes and modifications may be made without departing from the spirit and scope of the present invention.

What is claimed is:

1. A hydraulic apparatus, comprising in combination:

a hydraulic pump, a reservoir tank connected with said hydraulic pump and a change-over valve;

a first fluid passage having one end connected with said hydraulic pump and the other end connected with said change-over valve; a second fluid passage having one end connected with said change-over valve and the other end connected with said tank;

a hydraulic cylinder having first and second cylinder chambers which are partitioned by a piston accommodated in said hydraulic cylinder;

a first inlet-outlet passage having one end connected with said change-over valve and the other end connected with said first cylinder chamber;

a second inlet-outlet passage having one end connected with said change-over valve and the other end connected with said second cylinder chamber;

a valve means provided in said first inlet-outlet passage and closable as fluid under pressure passing through said first inlet-outlet passage from said hydraulic pump comes to be dropped below a predetermined pressure, said valve means including a check valve permitting fluid under pressure to be introduced into said first cylinder chamber from said change-over valve, a biasing plunger disposed in opposing relation with said check valve and movable toward and away from said check valve, a compression coil spring resiliently urging said biasing plunger away from said check valve, and a pilot passage having one end connected with said first fluid passage between said hydraulic pump and said change-over valve and the other end connected with said biasing plunger to enable fluid under pressure to be introduced into said biasing plunger from said hydraulic pump so that said biasing plunger is moved toward said check valve to bias and open said check valve; and a transmitting means transmitting a force generated by heat expansion of fluid under pressure in the first cylinder chamber to said biasing plunger so as to enable said biasing plunger to be moved toward said check valve against said compression coil spring so that said check valve is opened to cause fluid under pressure in said first cylinder chamber to be discharged therefrom.

2. A hydraulic apparatus as defined in claim 1, in which said transmitting means includes a rockable arm adapted to be rockable around its longitudinally intermediate portion to have one end engageable with said piston in said hydraulic cylinder and the other end engageable with said biasing plunger whereby said biasing plunger is moved toward said check valve when said piston is moved until said rockable arm is swung around its longitudinally intermediate portion.

3. A hydraulic apparatus as defined in claim 1, in which said biasing plunger is disposed in perpendicular relation with a movement direction of said piston, and in which said transmitting means includes an axial end extension formed in said biasing plunger to be engageable with said piston whereby said biasing plunger is moved toward said check valve when said piston is moved to be engaged with said axial end extension.

* * * * *